US009937408B2

(12) United States Patent
Mo

(10) Patent No.: US 9,937,408 B2
(45) Date of Patent: Apr. 10, 2018

(54) WEARABLE MOTORIZED DEVICE

(71) Applicant: Tiande Mo, Hong Kong (HK)

(72) Inventor: Tiande Mo, Hong Kong (HK)

( * ) Notice: Subject to any disclaimer, the term of this patent is extended or adjusted under 35 U.S.C. 154(b) by 0 days.

(21) Appl. No.: 15/063,568

(22) Filed: Mar. 8, 2016

(65) Prior Publication Data

US 2018/0008881 A1 Jan. 11, 2018

(51) Int. Cl.

| | |
|---|---|
| ***A63C 17/12*** | (2006.01) |
| ***A63C 17/22*** | (2006.01) |
| ***A63C 17/20*** | (2006.01) |
| ***A63C 17/26*** | (2006.01) |
| ***A63C 17/04*** | (2006.01) |

(52) U.S. Cl.
CPC ..... *A63C 17/12* (2013.01); *A63C 17/04* (2013.01); *A63C 17/20* (2013.01); *A63C 17/223* (2013.01); *A63C 17/262* (2013.01)

(58) Field of Classification Search
CPC ..... A63C 17/006; A63C 17/08; A63C 17/12
USPC ..... 280/78, 11.24; 180/181
See application file for complete search history.

(56) References Cited

U.S. PATENT DOCUMENTS

| | | | | | |
|---|---|---|---|---|---|
| 92,936 | A * | 7/1869 | Brownlee | A63C 17/08 | 280/11.24 |
| 3,663,031 | A * | 5/1972 | Young | A63C 17/08 | 280/11.204 |
| 4,109,741 | A * | 8/1978 | Gabriel | B62K 1/00 | 180/21 |
| 4,241,931 | A * | 12/1980 | Healy | B62K 17/00 | 280/205 |
| 4,363,493 | A * | 12/1982 | Veneklasen | A63C 17/08 | 280/11.204 |
| 4,401,314 | A * | 8/1983 | Zimmerman | A63B 19/02 | 280/206 |
| 5,106,110 | A * | 4/1992 | Williamson | A63C 17/08 | 188/72.9 |
| D347,044 | S * | 5/1994 | Slack | 280/11.24 | |
| 5,779,247 | A * | 7/1998 | Anselmo | A63C 17/08 | 280/11.24 |
| 6,382,640 | B1 * | 5/2002 | Killian | A63C 17/16 | 280/11.24 |
| 6,705,630 | B1 * | 3/2004 | Karpman | A63C 17/01 | 280/253 |

(Continued)

*Primary Examiner* — Jeffrey J Restifo
(74) *Attorney, Agent, or Firm* — Spruson & Ferguson (HK)

(57) ABSTRACT

A wearable motorized device comprising a shoe bracket, which has a ring-shaped structure and can be fastened to the middle part of a shoe; a wheel, which rotatably supports the shoe bracket to enable lateral skating and longitudinal walking; a driving motor, which rotationally drives the wheel; and a battery pack, which powers the driving motor. The wheels are not coaxially installed on the two sides of the shoe bracket to drive the wearer's longitudinal skating, but are installed on the ring-shaped shoe bracket, which can be fastened to the middle part of the shoe, to support the wearer's lateral skating and longitudinal walking. This way, the wearer can position his/her legs apart during skating; such that the skating stability is improved. Moreover, its general contour does not significantly exceed the contour of the shoe in the longitudinal direction, thus it will not strain the wearer when ascending or descending stairs. Therefore, a wearable motorized device with high skating stability and ease of use can be achieved.

10 Claims, 7 Drawing Sheets

(56) References Cited

U.S. PATENT DOCUMENTS

D624,136 S * 9/2010 Chen ..... A63C 17/00 D21/760
D624,137 S * 9/2010 Chen ..... A63C 17/00 D21/760
7,980,568 B2 * 7/2011 Chen ..... A63C 17/01 280/11.24
8,113,524 B2 * 2/2012 Karpman ..... A63C 17/016 280/11.19
8,464,822 B2 * 6/2013 Spector ..... B62K 3/00 180/181
8,613,453 B2 * 12/2013 Chen ..... A63C 17/00 280/11.24
8,616,313 B2 * 12/2013 Simeray ..... B62K 1/00 180/181
8,967,636 B2 * 3/2015 Horst ..... B60B 19/00 280/47.38
2002/0074176 A1 * 6/2002 Justus ..... A63C 5/08 180/181
2006/0273531 A1 * 12/2006 Jenkins ..... A63C 17/006 280/11.19
2010/0109266 A1 * 5/2010 Jenkins ..... A63C 17/006 280/11.204
2011/0059664 A1 * 3/2011 Poichot ..... A63C 17/0066 441/74
2012/0119455 A1 * 5/2012 Sun ..... A63C 17/004 280/11.19
2012/0285756 A1 * 11/2012 Treadway ..... A63C 17/12 180/65.51
2013/0032423 A1 * 2/2013 Chen ..... A63C 17/0073 180/218
2013/0161916 A1 * 6/2013 Chen ..... A63C 17/00 280/11.24
2014/0158446 A1 * 6/2014 Treadway ..... A63C 17/12 180/169
2015/0042054 A1 * 2/2015 Wu ..... A63C 17/12 280/11.115
2015/0107922 A1 * 4/2015 Bigler ..... A63C 17/12 180/181

* cited by examiner

WEARABLE MOTORIZED DEVICE

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE PRESENT INVENTION

The present invention relates to the field of wearable technology, particular to wearable motorized devices.

BACKGROUND

U.S. Patent Application Publication No. 2012/0285756A1 and U.S. Patent Application Publication No. 2014/0158446A1 disclose a wearable motorized device, which comprises a base for supporting the foot of a person and for holding the battery pack. The base is provided with raised side edges, raised rear edge, and two wheels of at least 5.5 inches in diameter. The two wheels are coaxially connected to the left and right sides of the raised side edges of the base plate. The wheel is having a wheel hub motor, and a motor controller is embedded therein. The base is also provided with a strap, which fastens the wearable motorized device to a shoe.

The wearable motorized device has the following shortcomings: the wearer's stability provided by the wearable motorized device is low due to the longitudinal length added to the wearer's feet, even when the wearer positions both her feet on the ground with one foot in front of the other during skating. This is so because the distance between the two feet with one in front of the other cannot be too large due to the limitation of the human body physique. It would otherwise cause awkwardness and discomfort to the wearer. As the battery pack is secured at the raised rear edge of the base plate, it greatly increases the length of the base, and the general contour of the motorized device far exceeds the contour of the shoe in the longitudinal direction. Thus, the wearer has to turn her feet sideways when ascending and descending stairs, causing awkwardness and inconvenience.

SUMMARY

The present invention provides a wearable motorized device, which overcomes the prior arts' shortcomings of low skating stability and inadequacy in accommodating stair climbing and descending actions.

In accordance to various embodiments of the present invention, a wearable motorized device is provided, which comprises: a shoe bracket, which has a ring-shaped structure and can be fastened to the middle part of a shoe; a wheel, which rotatably supports the shoe bracket to allow lateral skating motions and longitudinal walking motions; a driving motor, which drives the wheel rotationally; and a battery pack, which powers the driving motor.

In accordance to various embodiments of the wearable motorized device, the outer diameter of the wheel is not more than 8.5 inches.

In accordance to one embodiment, the wearable motorized device further comprises: a wheel cowl, which covers the upper part of the wheel and is securely connected to the shoe bracket. The wheel cowl also has a battery compartment and a battery compartment cover, wherein the battery pack is installed in the battery compartment. The battery pack comprises at least one battery, and the battery is arch-shaped.

In accordance to one embodiment, the shoe bracket comprises a wheel supporting part for securing the wheel; a motor supporting part for securing the driving motor; and a pedal for supporting the shoe. The radial inner side of the wheel is provided with a ring gear, and a pinion gear that engages the ring gear and connects to the driving motor.

In accordance to one embodiment, a front bearing and a rear bearing are provided between the wheel supporting part and the wheel, and the ring gear is configured to position between the front bearing and the rear bearing.

The front underside of the pedal is also provided with a front support, wherein the front support is not in contact with the ground during lateral skating, but in contact with the ground during longitudinal walking. This facilitates the walking motions of the wearer. The rear underside of the pedal is also provided with a rear support, and the rear support is not in contact with the ground during lateral skating, but in contact with the ground during longitudinal walking. This facilitates the walking motions of the wearer.

The front upside of the pedal is also provided with a front strap, which is used to securely fasten the front part of the shoe to the said pedal. The wheel cowl is also provided with an ankle strap, which is used to securely fasten the wheel cowl to the wearer's ankle.

In accordance to various embodiments, the wheels are not coaxially installed on the two sides of the shoe bracket to drive the wearer's longitudinal skating, but are installed on the ring-shaped shoe bracket, which can be fastened to the middle part of the shoe, to support the wearer's lateral skating and longitudinal walking. This way, the wearer can position his/her legs apart during skating, improving the skating stability. Moreover, its general contour does not significantly exceed the contour of the shoe in the longitudinal direction, thus it will not strain the wearer when ascending or descending stairs. Therefore, a wearable motorized device with high skating stability and ease of use can be achieved.

BRIEF DESCRIPTION OF THE DRAWINGS

Embodiments of the present invention are described in more detail hereinafter with reference to the drawings, in which.

Figure 1:
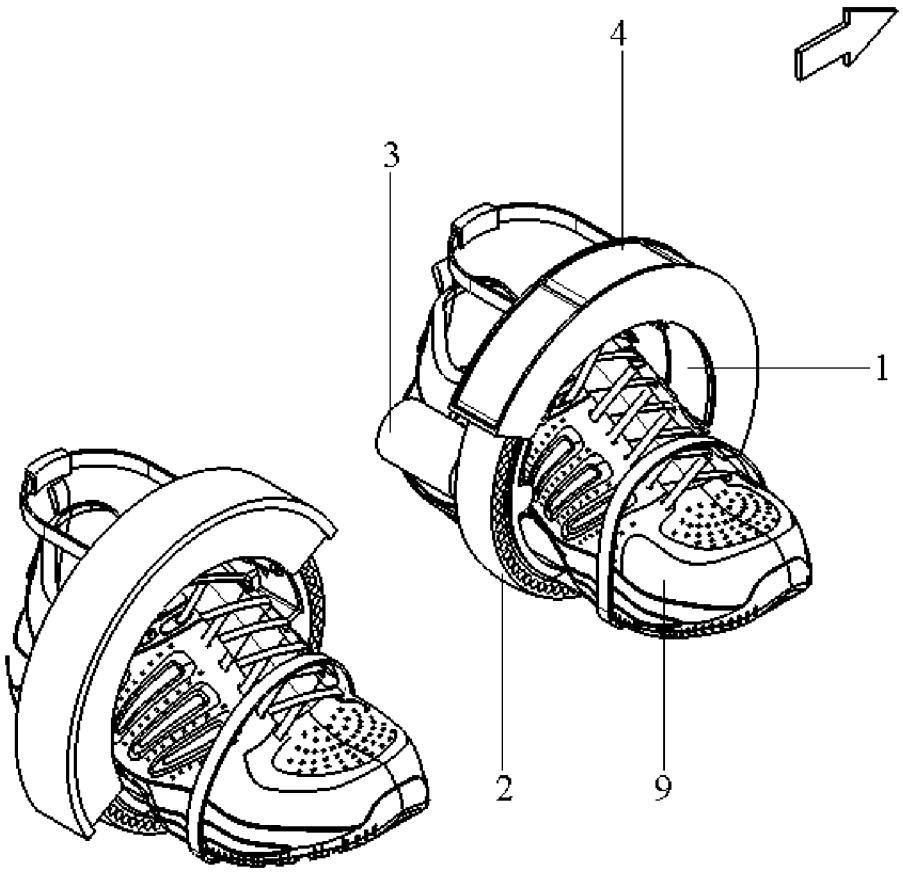
FIG. 1 is the schematic view of the overall structure of the wearable motorized device in accordance to one embodiment of the present invention.

As shown in the drawings, reference labels 1, 11, 12, 13, 14, 15, and 16 refer to the shoe bracket, the wheel supporting part, the motor supporting part, the pedal, the front support, the rear support, and the front strap respectively; 2, 21, 22, 23, and 24 refer to the wheel, the ring gear, the pinion gear, the front bearing, and the rear bearing respectively; 3 refers to the driving motor; 4 and 41 refer to the battery pack and the battery respectively; 5, 51, 52, and 53 refer to the wheel cowl, the battery compartment, the battery compartment cover, and the ankle strap respectively; and 9 refers to the shoe.

DETAILED DESCRIPTION

In the following description, designs of wearable motorized devices are set forth as preferred examples. It will be apparent to those skilled in the art that modifications, including additions and/or substitutions may be made without departing from the scope and spirit of the present invention. Specific details may be omitted so as not to obscure the present invention; however, the disclosure is written to enable one skilled in the art to practice the teachings herein without undue experimentation. It should be understood that the embodiments disclosed herein are intended to illustrate and not to limit the present invention.

FIG. 1 is the schematic view of the overall structure of the wearable motorized device in accordance to a first embodiment of the present invention. Referring to FIG. 1, the wearable motorized device comprises: a shoe bracket 1, which has a ring-shaped structure and can be fastened to the middle part of a shoe 9; a wheel 2, which rotatably supports the shoe bracket 1, enabling lateral skating and longitudinal walking motions; a driving motor 3, which drives the wheel 2 rotationally; and a battery pack 4, which powers the driving motor 3.

In accordance to various embodiments, the wheels are not coaxially installed on the two sides of the shoe bracket to drive the wearer's longitudinal skating, but are installed on the ring-shaped shoe bracket, which can be fastened to the middle part of the shoe, to support the wearer's lateral skating and longitudinal walking. This way, the wearer can position his/her legs apart during skating, improving the skating stability. Moreover, its general contour does not significantly exceed the contour of the shoe in the longitudinal direction, thus it will not strain the wearer when ascending or descending stairs. Therefore, a wearable motorized device with high skating stability and ease of use can be achieved.

Figure 2:
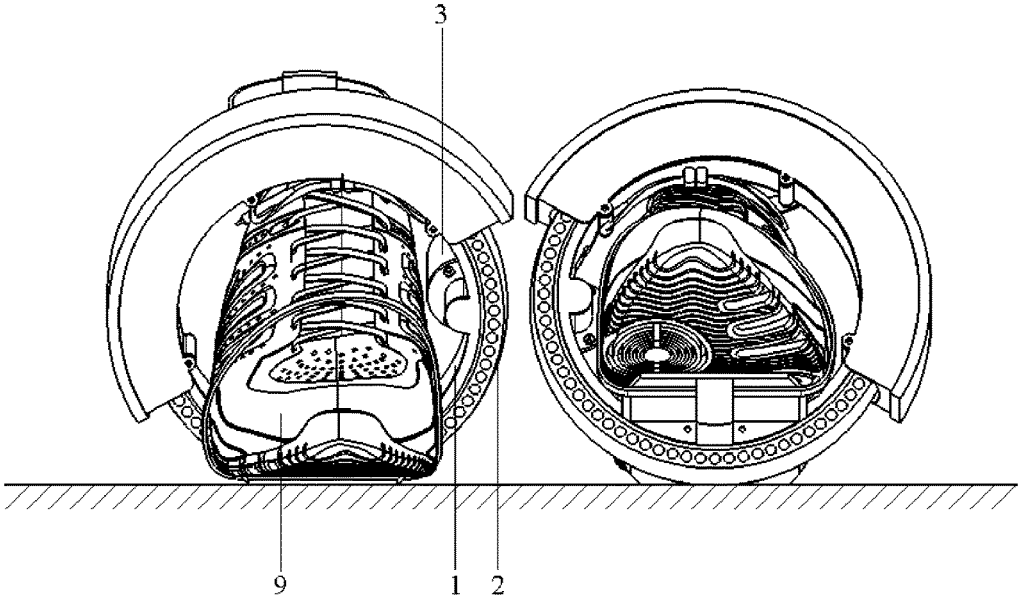
FIG. 2 is the forward schematic view of the wearable motorized device in accordance to one embodiment of the present invention, which is in contact with the ground during longitudinal walking.
Figure 3:
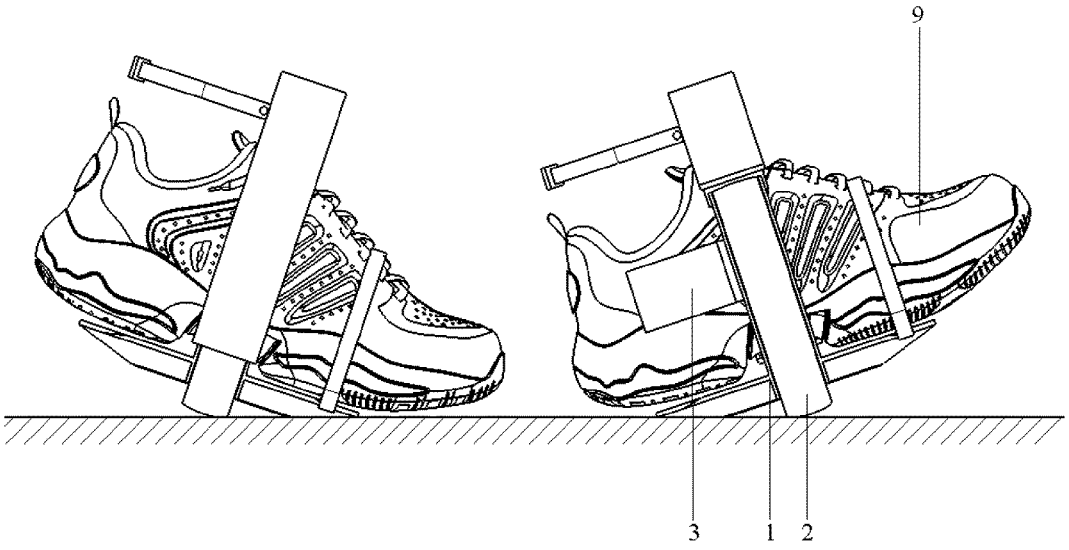
FIG. 3 is the lateral schematic view of the wearable motorized device shown in FIG. 2, which is in contact with the ground during longitudinal walking.

FIG. 2 is the forward schematic view of the wearable motorized device in accordance to an embodiment of the present invention, which is in contact with the ground during longitudinal walking; FIG. 3 is the lateral schematic view of the wearable motorized device shown in FIG. 2, which is in contact with the ground during longitudinal walking.

Referring to FIGS. 2 and 3, the distance of separation between an average person's feet is about 100 mm during standing or longitudinal walking. People of different heights have different foot lengths or wear different sizes of shoes. Thus, a large cavity of shoe bracket 1 is desirable in accommodating the possible largest shoe size, whereas a small outer diameter of wheel 2 is desirable so that the wearer does not need to position his/her feet far apart and the wearer's normal gait does not get affected. According to the analysis using a pair of standard European-size 44 sport shoes, when the outer diameter of the wheel 2 is not more than 8.5 inches (or 216 mm), the standard European-size 44 sport shoe can be inserted into the shoe bracket 1, and the wheel 2 does not impede normal walking. Of course, the shoe bracket 1 can also be designed according to different shoe sizes for better suitability, and more unhindered and comfortable walking.

In comparison with the 5.5-inch wheels described in U.S. Patent Application Publication No. 2012/0285756A1 and U.S. Patent Application Publication No. 2014/0158446A1, the 8.5-inch wheels 2 according to the embodiments of the present invention provide greater obstacle-overcoming capability in that when skating the wearer is not so easily tripped over potholes or hitting debris on the road.

Figure 4:
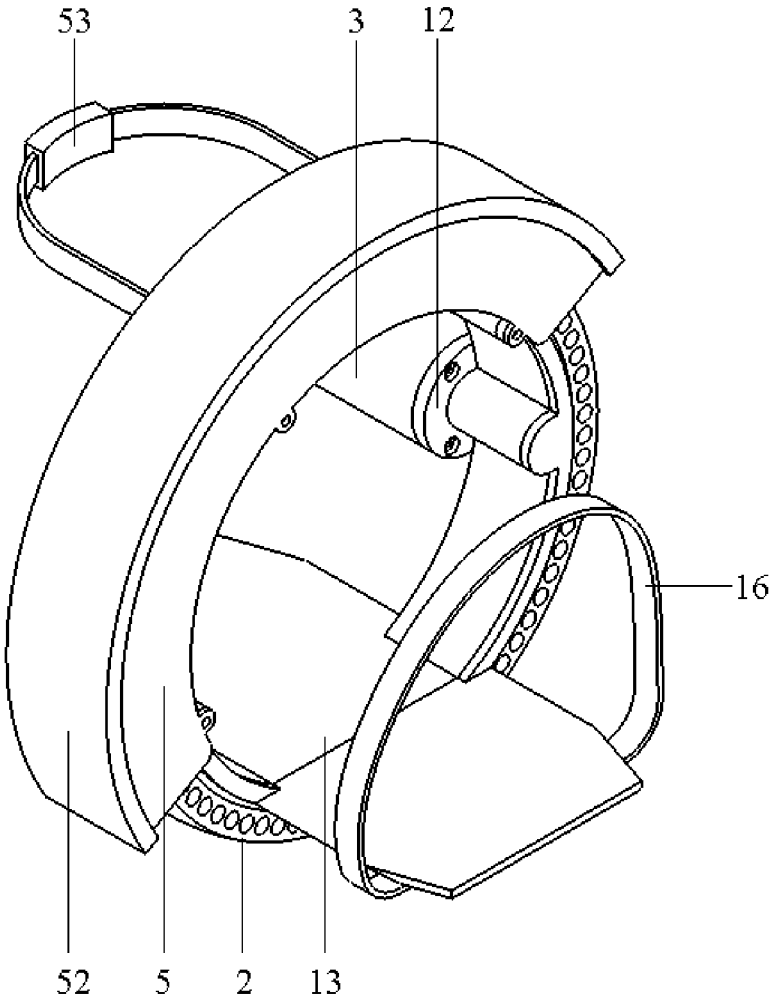
FIG. 4 is the forward three-dimensional structural diagram of the wearable motorized device shown in FIG. 2.
Figure 5:
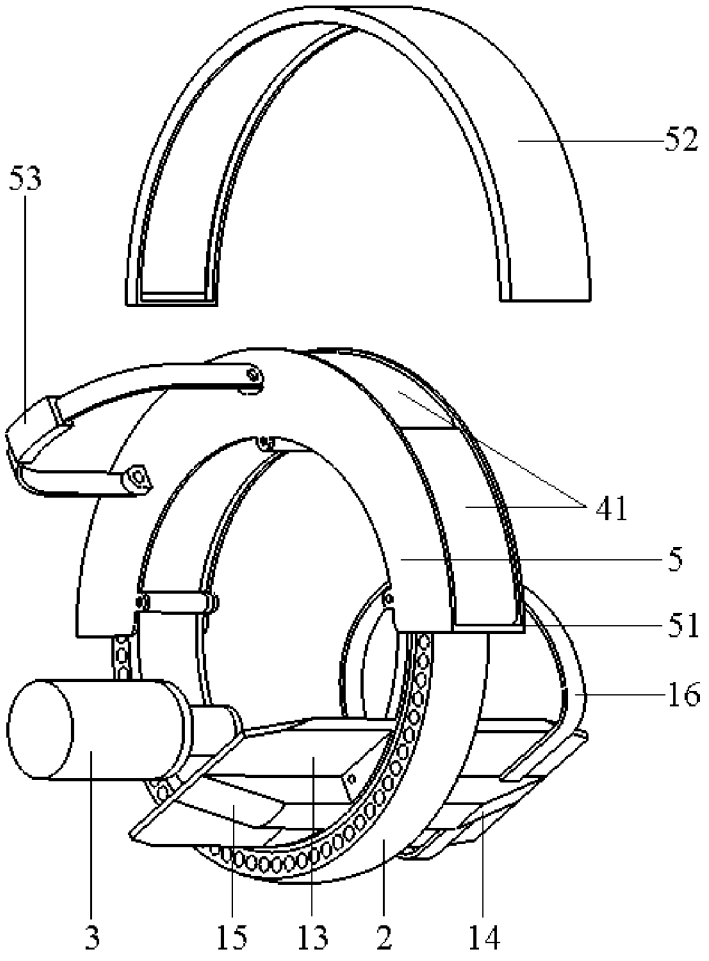
FIG. 5 is the backward three-dimensional structural diagram of the wearable motorized device shown in FIG. 2.
Figure 6:
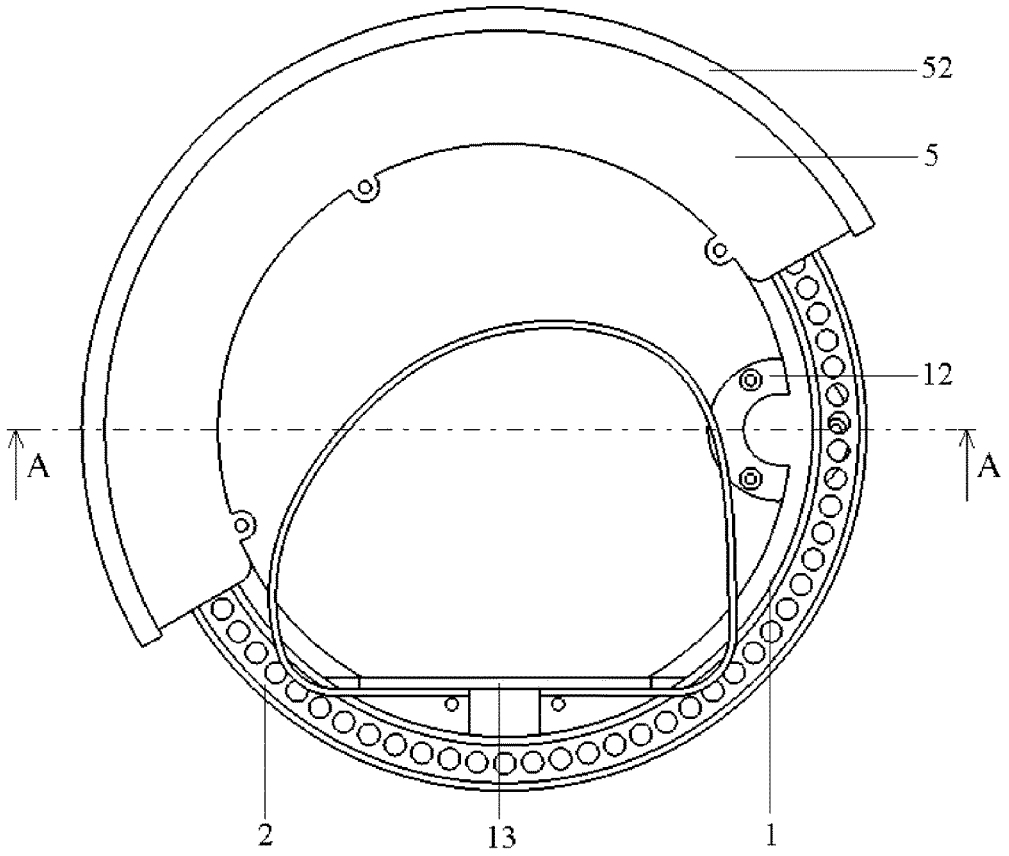
FIG. 6 is the front view of the wearable motorized device shown in FIG. 2.
Figure 7:
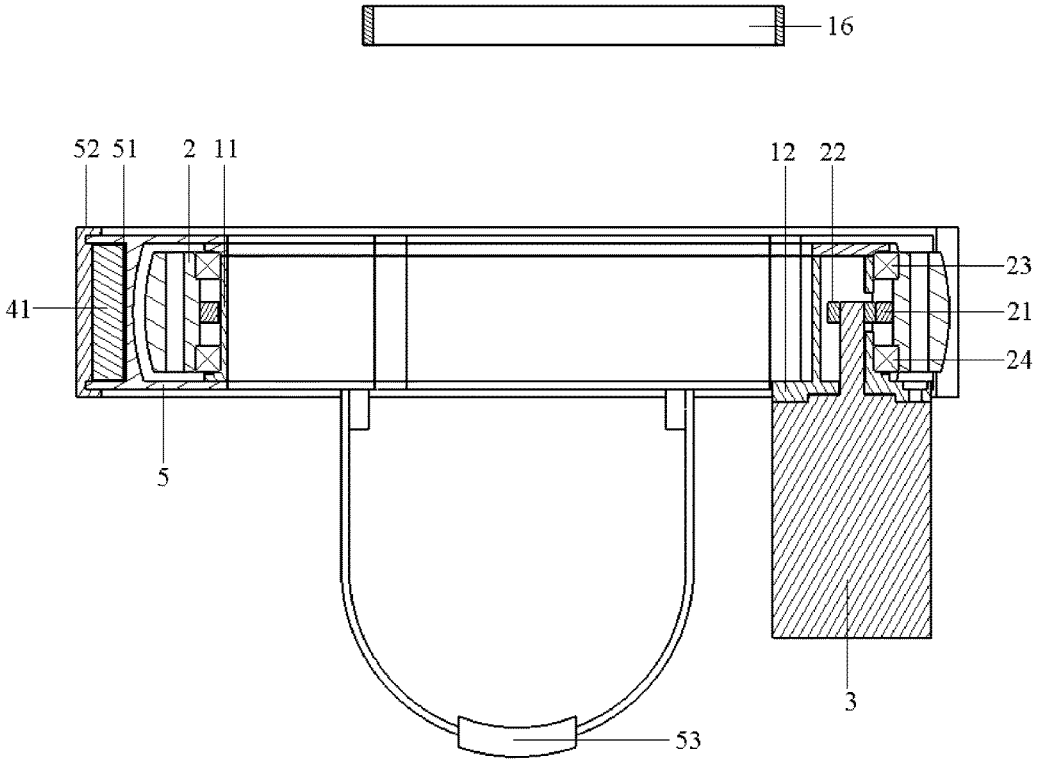
FIG. 7 is the A-A half-sectional view of the wearable motorized device shown in FIG. 2.

FIG. 4 is the forward three-dimensional structural diagram of the wearable motorized device shown in FIG. 2. FIG. 5 is the backward three-dimensional structural diagram of the wearable motorized device shown in FIG. 2. FIG. 6 is the front view of the wearable motorized device shown in FIG. 2. And FIG. 7 is the A-A half-sectional view of the wearable motorized device shown in FIG. 2.

Referring to FIGS. 4-7, the wearable motorized device further comprises: a wheel cowl 5, which covers the upper part of the wheel 2 and is securely connected to the shoe bracket 1. The wheel cowl 5 does not only guard against splashed up mud and dirt from the rotating wheel 2, but also blocks the wearer's lower leg from contacting the rotating wheel 2. The wheel cowl 5 also provides the wearable motorized device a point of support to the wearer's lower leg.

The wheel cowl 5 contains a battery compartment 51, and a battery pack 4 is installed in the battery compartment 51. As the overall contour of the wearable motorized device is extremely compact, the battery pack 4 is fixed on the wheel cowl 5. The side face of the wheel cowl 5 is fan-shaped, and the size of its inner side close to the wearer's foot is limited. The contour of its inner side does not extend beyond the outer edge of the wheel 2, so as not to inhibit longitudinal walking. The fan-shaped arc corresponding to the wheel cowl 5 can reach up to 180°, so as to accommodate the battery pack 4 of capacity sufficiently large for supplying power to the driving motor 3.

The battery pack 4 comprises at least one battery 41, and the battery 41 is arch-shaped. As the battery compartment 51 has a fan-shaped space, the battery 41 being arch-shaped takes full advantage of and fits tightly into the space. The battery 41 can be a lithium ion polymer battery manufactured to the desired arch shape. The battery 41 can also be a cylindrical battery. In the case where the battery 41 is a lithium-ion battery, the battery protection board or battery management board required for ensuring the battery's normal operation may also be made into a fan shape. The charging port may also be provided on the wheel cowl 51. The present invention, however, is not limited to the aforesaid battery system designs and other designs apparent to an ordinarily skilled person in the art can be adopted without departing from the scope of the present invention.

The shoe bracket 1 comprises the wheel supporting part 11 for securing the wheel; the motor supporting part 12 for securing the driving motor 3, and the pedal 13 for supporting the shoe 9. The shoe bracket 1 can be integrally made of aluminum alloy, magnesium alloy, engineering plastics, carbon fiber, or other materials, so as to provide sufficient rigidity and strength while reducing weight as much as possible. As a wearable device, one of the primary objectives is being lightweight for minimizing the burdens and discomfort to the wearer.

To transmit the driving force of the driving motor 3 to the wheel 2 to drive the rotation of the wheel 2, a plurality of driving methods are available. In one embodiment, friction transmission is employed. In this driving method, a small friction wheel is provided adjacent to the wheel 2, and the small friction wheel presses on the tread or sidewall of the wheel 2. The small friction wheel receives the driving force of the driving motor 3 and transmits the driving force to the wheel 2 through friction. However, the efficiency of friction transmission is relatively low, and friction transmission is prone to excessive wearing, resulting in reduced service life of the device. The pressing force can also lead to reduced service life of the bearing; thus, the use of gear transmission, particularly enclosed gear transmission, is preferred.

The radial inner side of the wheel 2 is provided with a ring gear 21, and a pinion gear 22 that engages the ring gear 21 and connected to the driving motor 3. The wheel 2 maybe made of rubber or polyurethane, and may also include a wheel rim so that the inner side of the wheel rim can be provided with the ring gear 21. However, in order to reduce weight and number of components, the ring gear 21 can be manufactured directly on the radial inner side of the wheel 2, or the ring gear 21 can be manufactured separately and then integrated with the wheel 2. For example, the ring gear 21 can be manufactured on the radial inner side of the wheel 2 in the case that the wheel is made of rubber. Or the ring gear 21 can be made of metal and be embedded into the inner side of the wheel 2 made of rubber. The present invention, however, is not limited to the aforesaid wheel and gear designs and other designs apparent to an ordinarily skilled person in the art can be adopted without departing from the scope of the present invention.

To arrive at the enclosed gear transmission, the front bearing 23 and the rear bearing 24 are provided between the wheel supporting part 11 and the wheel 2, and the ring gear 21 is configured to position between the front bearing 23 and the rear bearing 24. The front bearing 23 and the rear bearing 24 thus requires only an outer sealing cover. The ring gear 21 and the pinion gear 22 work in the enclosed space formed by the front bearing 23, the rear bearing 24, and the shoe bracket 1. This is so to protect against water and dust, and guarantee a reliable service life of the device.

In one embodiment, the front bearing 23 and the rear bearing 24 are thin-walled metal bearings or self-lubricating thin-walled engineering plastic bearings. They do not only provide the desired large cavity in the shoe bracket 1, but also reduce the weight and friction. For example, a thin-walled bearing has an outer diameter of 177.8 mm, an inner diameter of 165.1 mm, and a width of 6.5 mm.

The front underside of the pedal 13 is also provided with a front support 14, and the front support 14 is not in contact with the ground during lateral skating, but in contact with the ground during longitudinal walking to facilitate walking motions. The wearable motorized device according to the embodiments of the present invention allows a ground clearance of the shoe 9 to be as low as about 40 mm such that the wearer can walk naturally. In the case where the front support 14 is provided, however, it further eases the walking motions and also assists in braking during skating. The front support 14 can be made of rubber or shoe sole material to achieve said functions.

The rear underside of the pedal 13 is also provided with a rear support 15, and the rear support 15 is not in contact with the ground during lateral skating, but in contact with the ground during longitudinal walking to facilitate walking motions. Similar to the front support 14, the rear support 15 is provided to further ease the walking motions and assist in braking during skating. It can be made of rubber or shoe sole material to achieve the said functions.

As a wearable motorized device, the shoe bracket 1 shall be securely fastened to the shoe 9, so that the device becomes an extension to the foot in enhancing the wearer's mobility. The front upside of the pedal 13 is also provided with a front strap 16, which is used to securely fasten the front part of the shoe 9 to the pedal 13. The front strap 16 can be adjusted to have an appropriate circumference accommodating the front part of the shoe of different sizes and types. This is so to fasten and retain the front part of the shoe 9 when the shoe 9 is positioned and strapped around by the front strap 16.

In addition, the wheel cowl 5 may also be provided with an ankle strap 53, which is used to securely fasten the wheel cowl 5 to the wearer's ankle. The ankle strap 53 can securely fasten the wearable motorized device to the wearer's ankle. As a single wheel design, the wheel 2 inevitably gets close to the front portion of the lower leg. The contact between the wheel cowl 3 and the front portion of the lower leg provides the function of axial positioning of the wheel 2. The ankle strap 53 does not only fasten the wearable motorized device to the wearer's ankle during skating and walking, but also can be used by the wearer to carry the wearable motorized device when it is taken off.

The aforesaid embodiments of the wearable motorized device can also be modified appropriately to obtain the following modified embodiments of the present invention:

In the second modified embodiment, the driving motor 3 is installed on the shoe bracket 1; and the battery pack 4 is installed on the shoe bracket 1.

In the third modified embodiment, the driving motor 3 is installed on the shoe bracket 1; and the battery pack 4 is worn on the wearer's body.

It should be noted that in the wearable motorized device according to the embodiments of the present invention, larger cavity and smaller outer diameter are desired due to structural limitations, and it is not preferred to use a hub motor as the driving motor 3.

Optionally, a raised edge is fashioned at the back of the shoe bracket 1, upon where the battery pack 4 can be installed. The battery pack 4 can be manufactured in the form of a packet worn on the wearer's body at e.g. the waist or back, and be electrically connected to the driving motor 3 by shielded electrical wire. In this case, a larger battery pack 4 can be used to increase the operational range of the wearable motorized device.

In the fourth modified embodiment, both the driving motor 3 and the battery pack 4 are worn on the wearer's body. The wearable motorized device further comprises a flexible shaft, which is used to transfer the driving force of the driving motor 3 to the wheels 2. When the driving motor 3 and the battery pack 4 are worn on the wearer's body, the shoe bracket 1 is in the most maneuverable structure with the lightest weight, so as to achieve flexible skating and easy walking. In addition, larger driving motor 3 and battery pack 4 can also be provided to achieve higher skating speed and longer skating distance.

It should be noted that due to manufacturing, assembly, and functional needs, the shoe bracket 1 may comprise components made of different materials, which are connected together by bolts, clasps, and other means. The present invention, however, is not limited to the aforesaid manufacture and material designs, and other designs apparent to an ordinarily skilled person in the art can be adopted without departing from the scope of the present invention.

The foregoing description of the present invention has been provided for the purposes of illustration and description. It is not intended to be exhaustive or to limit the present invention to the precise forms disclosed. Many modifications and variations will be apparent to the practitioner skilled in the art.

The embodiments were chosen and described in order to best explain the principles of the present invention and its practical application, thereby enabling others skilled in the art to understand the present invention for various embodiments and with various modifications that are suited to the particular use contemplated. It is intended that the scope of the present invention be defined by the following claims and their equivalence.

What is claimed is:

1. A wearable motorized device, comprising:

a shoe bracket having a ring-shaped structure for fastening to a shoe;

a wheel for rotatably supporting the shoe bracket and allowing lateral skating motions and longitudinal walking motions;

a wheel cowl for covering an upper part of the wheel, the wheel cowl being securely connected to the shoe bracket;

a driving motor for rotationally driving the wheel; and a battery pack for powering the driving motor;

wherein the wheel cowl comprises a battery compartment and a battery compartment cover, and wherein the battery pack is installed in the battery compartment.

2. The wearable motorized device according to claim 1, wherein an outer diameter of the wheel is not more than 8.5 inches.

3. The wearable motorized device according to claim 1, wherein the battery pack comprises at least one battery; and wherein the battery is arch-shaped.

4. The wearable motorized device according to claim 1, wherein the shoe bracket comprises:

a wheel supporting part for securing the wheel;

a motor supporting part for securing the driving motor; and a pedal for supporting the shoe.

5. The wearable motorized device according to claim 4, wherein a radial inner side of the wheel comprises:

a ring gear; and a pinion gear engaging with the ring gear and being connected to the driving motor.

6. The wearable motorized device according to claim 5, further comprising:

a front bearing; and a rear bearing;

wherein the front bearing and the rear bearing are configured to position between the wheel supporting part and the wheel; and wherein the ring gear is configured to position between the front bearing and the rear bearing.

7. The wearable motorized device according to claim 4, wherein a front underside of the pedal has a front support; and wherein the front support is not in ground contact during lateral skating, but in ground contact during longitudinal walking.

8. The wearable motorized device according to claim 4, wherein a rear underside of the pedal has a rear support; and wherein the rear support is not in ground contact during lateral skating, but in ground contact during longitudinal walking.

9. The wearable motorized device according to claim 7, wherein a front upside of the pedal is provided with a front strap for securely fastening the shoe to the pedal.

10. The wearable motorized device according to claim 3, wherein the wheel cowl is provided with an ankle strap for securely fastening the wheel cowl to a wearer's ankle.

* * * * *